US006113098A

United States Patent [19]

Adams

[11] Patent Number: 6,113,098

[45] Date of Patent: Sep. 5, 2000

[54] GAMING DEVICE WITH SUPPLEMENTAL TICKET DISPENSER

[75] Inventor: William R. Adams, Las Vegas, Nev.

[73] Assignee: Anchor Gaming, Las Vegas, Nev.

[21] Appl. No.: 09/157,993

[22] Filed: Sep. 22, 1998

[51] Int. Cl.[7] ..... A63F 1/18

[52] U.S. Cl. ..... 273/143 R; 273/138 A; 273/139; 463/17

[58] Field of Search ..... 273/138.1, 138.2, 273/139, 143 R; 463/16, 17, 18, 20, 25, 26, 27, 28

[56] References Cited

U.S. PATENT DOCUMENTS 4,689,742 8/1987 Troy et al. .
5,265,874 11/1993 Dickinson et al. .
5,290,033 3/1994 Bittner et al. .
5,487,544 1/1996 Clapper, Jr. ..... 273/138 A
5,489,096 2/1996 Aron ..... 273/138 R
5,609,337 3/1997 Clapper, Jr. ..... 273/138.2
5,645,485 7/1997 Clapper, Jr. ..... 463/17
5,647,592 7/1997 Gerow ..... 273/139
5,749,784 5/1998 Clapper, Jr. ..... 463/17

*Primary Examiner*—Jeanette Chapman
*Assistant Examiner*—Raeann Gorden
*Attorney, Agent, or Firm*—Galgano & Burke

[57] ABSTRACT

Gaming devices dispense tickets which are supplemental to the gaming award. The gaming devices provide gaming awards, typically in a form selected from the group consisting of coins, currency, credits or redeemable tickets in response to a randomly determined event, and also provide supplemental tickets.

34 Claims, 2 Drawing Sheets

GAMING DEVICE WITH SUPPLEMENTAL TICKET DISPENSER

The present invention relates to gaming devices and, more particularly, to gaming devices with a supplemental ticket dispenser.

BACKGROUND OF THE INVENTION

Gaming devices have been known which dispense winning awards in various forms. For example, it has been known to dispense winning prizes which are generated if a randomly determined outcome is one of a preselected plurality of winning outcomes from a greater plurality of possible outcomes. Such awards have been provided to players in the form of coins, currency, credits or tickets redeemable for prizes.

The assignee of the present invention owns U.S. Pat. No. 5,397,125 entitled GAMING DEVICE WITH PAYOUTS OF MULTIPLE FORMS wherein winning players are provided with the opportunity of receiving payouts in at least two distinct forms, both of which are inherently valuable. For example, according to one embodiment, a first payout comprises a national currency while another form of payout comprises tokens formed of a precious metal such as silver or gold. It has also been previously disclosed to dispense either checks in a form redeemable at a bank or other "redeemable tickets", i.e., tickets which are redeemable for prizes at a gaming establishment.

It is believed that all of the prior art which dispenses various forms of awards provided those awards only if a player had won a game on the gaming device.

SUMMARY OF THE INVENTION

The present invention comprises various embodiments of gaming devices which dispense tickets which are supplemental to the gaming award. As used herein, the term "gaming award" is used to indicate an award provided to a player if the outcome of some randomly determined event is at least one of a plurality of possible winning outcomes. The gaming devices of the present invention provide gaming awards, typically in a form selected from the group consisting of coins, currency, credits or "redeemable tickets" in response to a randomly determined event, and also provide supplemental "tickets". As used herein, the term "tickets", is used to broadly indicate to its recipient an item which may not have any inherent value such as an advertisement or announcement, however, it may be redeemable for services, currency, discounts or other goods of value.

According to some embodiments of the present invention, gaming devices are provided which randomly determine and then provide a gaming award, and also comprise means for dispensing tickets independently of a random event determining device. According to a still further embodiment, supplemental tickets are dispensed in response to one or more particular outcomes of the random event determining device only at various times or depending upon some other criteria, and in addition to the gaming award.

These and other embodiments are described below.

DETAILED DESCRIPTION OF THE PREFERRED EMBODIMENTS

Figure 1:
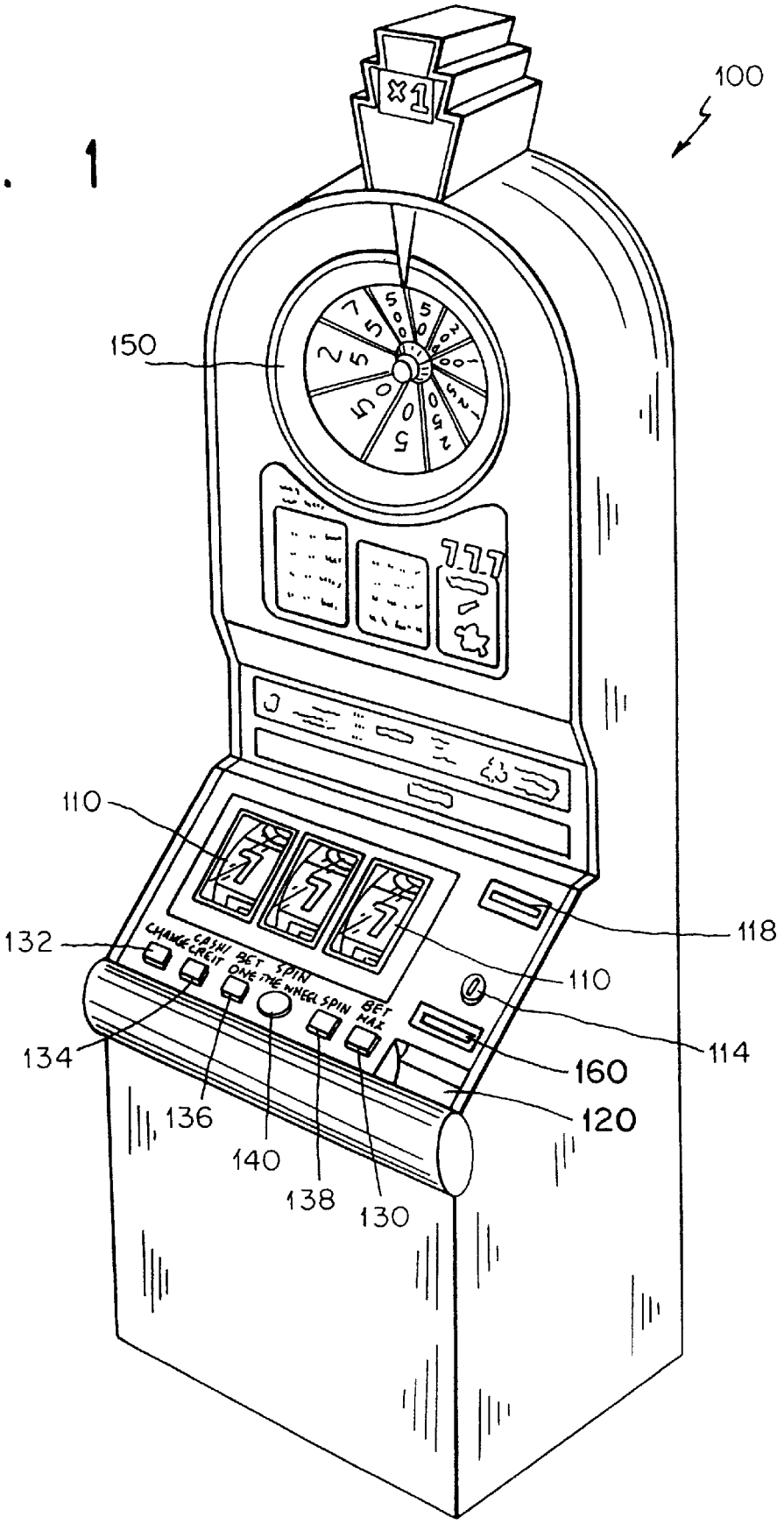
FIG. 1 illustrates one embodiment of the present invention.
Figure 2:
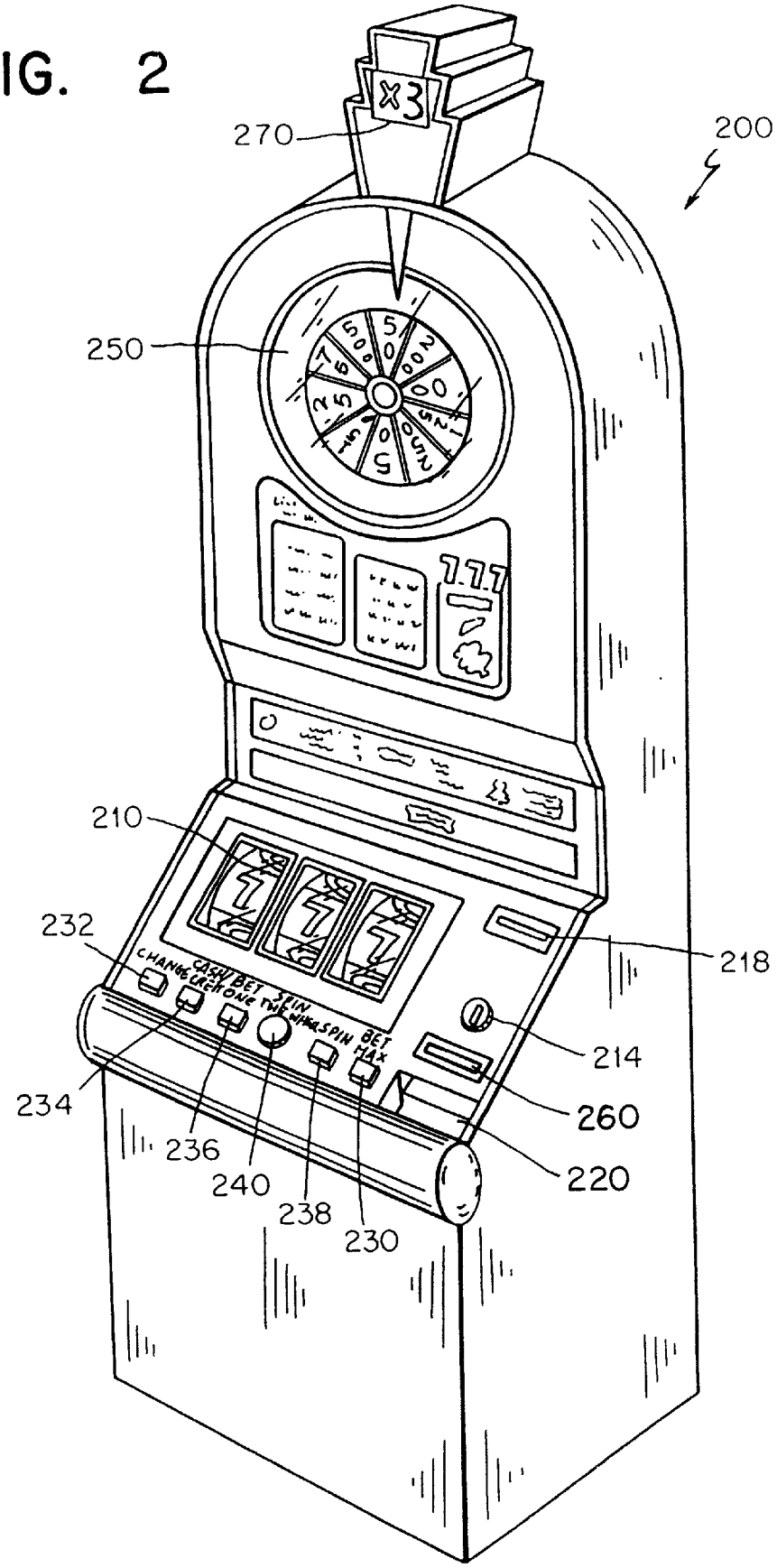
FIG. 2 illustrates a second embodiment of the present invention.

The various embodiments of the present invention relate to gaming devices comprising supplemental ticket dispensers which dispense tickets in addition to the gaming award provided by the gaming device when a winning outcome is randomly selected from a plurality of possible outcomes. One preferred embodiment of the present invention is illustrated in FIG. 1 wherein a gaming device 100 comprises a primary gaming unit in the form of a standard 3-reel slot machine which displays reels 110. Suitable controls and currency mechanisms including a coin slot 114, bill validator 118, payout chute 120 are provided. Furthermore, suitable player controls including CHANGE button 132, CASH/CREDIT button 134, BET ONE button 136, SPIN button 138 and BET MAX button 130 are also provided. In addition above the payout chute 120 is a supplemental ticket dispenser 160. In a similar video-display gaming device illustrated in FIG. 2, the primary reels are illustrated on a video display 210 and a secondary event in the form of a video display of a rotatable reel 250 is provided. Furthermore, the outcome of the secondary gaming unit can be increased by a multiplier 270. In a manner similar to the embodiment illustrated in FIG. 1, suitable controls and currency mechanisms including a coin slot 214, bill validator 218, payout chute 220 are provided. Furthermore, suitable player controls including CHANGE button 232, CASH/CREDIT button 234, BET ONE button 236, SPIN button 238 and BET MAX button 230 are also provided. In addition above the payout chute 220 is a supplemental ticket dispenser 260. As indicated in the figure, the supplemental ticket dispenser is preferably, but not necessarily, separate and distinct from the portion of the gaming device which provides the gaming awards. Those skilled in the art will appreciate that gaming awards are typically provided or indicated in the form of coins, currency, credits or redeemable tickets in response to a randomly determined outcome by the gaming device. According to one embodiment of the present invention, a gaming device is provided with a supplemental ticket dispenser which dispenses advertisements. For example, advertisements for a product or service unrelated to the gaming establishment can be provided. Additionally, goods or services typically provided by the gaming establishment can either be advertised or the supplemental ticket can be in the form of a coupon redeemable for such goods or services, such as free meals, free room, a show, a free play at the gaming device which dispensed the supplemental ticket, or a free play at another game. From the present description, those skilled in the art will appreciate that the supplemental ticket dispenser of the present invention can be utilized to introduce players to new games at the gaming establishment.

The supplemental ticket dispenser can dispense supplemental tickets in response to signals generated by the gaming establishment in response to a signal input at a remote location. According to another embodiment of the present invention, the supplemental ticket dispenser of the present invention will dispense supplemental tickets randomly throughout the day. According to one preferred embodiment, the random dispensing of supplemental tickets can require that the specific gaming device is being played, however, according to still another embodiment of the present invention, supplemental tickets are dispensed randomly throughout the day even if the gaming device is not being played at that time.

According to still another embodiment of the present invention, tickets can be dispensed depending upon the outcome of another gaming device. For example, gaming devices within a certain area, such as those in close proximity to a first gaming device will receive supplemental tickets if that first device achieves at least one of a plurality of possible awards. For example, if one gaming device provides a substantial prize, surrounding gaming devices can be provided with a consolation supplemental ticket thereby adding to and expanding the merriment and excitement in that particular area of the gaming establishment.

According to another embodiment of the present invention, supplemental tickets will only be dispensed if the gaming device containing the supplemental ticket dispenser is being played at a certain minimum rate of play, e.g. four plays per minute. Thus, the rate of play can be a threshold above which the player must play to qualify for a supplemental ticket, while the actual dispensing of the supplemental ticket will depend on another criteria, such as a timer, a random number generator, etc.

According to another embodiment of the present invention, supplemental tickets are only dispensed if a player has placed a player tracking card in the gaming device. The supplemental ticket dispensed in accordance with the present invention is supplemental to any value typically associated with a player tracking card.

The supplemental tickets can be promotional tickets which do not have any inherent or redeemable value other than to provide information relating to a product or service which is available either at the gaming establishment or elsewhere. Preferably, however, the supplemental tickets are redeemable for some product or service. For example, the supplemental ticket can be redeemable for a play on the gaming device from which is was dispensed or at some other game. Additionally, the supplemental tickets can be redeemable for services provided by the gaming establishment. Furthermore, the supplemental tickets can be in the form of scratch-off tickets which when scratched off can provide monetary prizes, goods or services.

What is claimed is:

1. A gaming device comprising:

means for receiving a wager;

means for randomly determining at least one of a plurality of possible outcomes;

means for providing a gaming award in a form selected from the group consisting of coins, currency, credits or redeemable tickets in response to said determining means; and means for dispensing tickets which is operable independent of said determining means.

2. A gaming device according to claim 1 further comprises a reel display.

3. A gaming device according to claim 1 further comprising a video display.

4. A gaming device according to claim 1 wherein said dispensing means is operable independent of said providing means.

5. A gaming device according to claim 1 wherein said dispensing means dispenses a ticket after a predetermined number of plays on said gaming device.

6. A gaming device according to claim 1 wherein said dispensing means dispenses a ticket randomly while said gaming device is being played.

7. A gaming device according to claim 1 wherein said dispensing means dispenses a ticket randomly regardless of whether said gaming device is being played.

8. A gaming device according to claim 1 wherein said dispensing means dispenses a ticket if said gaming device is being played at a certain rate of play.

9. A gaming device according to claim 1 further comprising means for receiving a player tracking card, and said dispensing means only dispenses tickets if a player tracking card has been inserted in said gaming device.

10. A gaming device according to claim 1 wherein said dispensing means dispenses promotional tickets.

11. A gaming device according to claim 1 wherein said dispensing means dispenses tickets redeemable for at least one play on said gaming device.

12. A gaming device according to claim 1 wherein said dispensing means dispenses tickets redeemable for at least one play on another gaming device.

13. A gaming device according to claim 1 wherein said dispensing means dispenses tickets redeemable for services provided by a gaming establishment.

14. A gaming device according to claim 1 wherein said dispensing means dispenses scratch-off tickets.

15. A gaming device according to claim 1 further comprising a secondary gaming unit comprising means for displaying a randomly selected second indicia from a plurality of possible secondary indicia.

16. A gaming device according to claim 15 wherein said secondary gaming unit comprises a wheel.

17. A gaming device comprising:

means for receiving a wager;

means for randomly determining at least one of a plurality of possible outcomes;

means for providing a gaming award in a form selected from the group consisting of coins, currency, credits or redeemable tickets in response to said determining means; and means for dispensing supplemental tickets independent of said gaming award wherein said supplemental tickets which are different from said gaming award.

18. A gaming device according to claim 17 further comprising display reels.

19. A gaming device according to claim 17 further comprising a video display.

20. A gaming device according to claim 1 wherein said dispensing means is operable independent of said determining means.

21. A gaming device according to claim 17 wherein said dispensing means dispenses tickets after a predetermined number of plays on said gaming device.

22. A gaming device according to claim 17 wherein said dispensing means dispenses tickets randomly while said gaming device is being played.

23. A gaming device according to claim 17 wherein said dispensing means dispenses tickets randomly regardless of whether said gaming device is being played.

24. A gaming device according to claim 17 wherein said dispensing means dispenses tickets if said gaming device is being played at a certain rate of play.

25. A gaming device according to claim 17 further comprising means for receiving a player tracking card, and said dispensing means only dispenses tickets if a player tracking card has been inserted in said gaming device.

26. A gaming device according to claim 17 wherein said dispensing means dispenses promotional tickets.

27. A gaming device according to claim 17 wherein said dispensing means dispenses tickets redeemable for at least one play on said gaming device.

28. A gaming device according to claim 17 wherein said dispensing means dispenses tickets redeemable for at least one play on another gaming device.

29. A gaming device according to claim 17 wherein said dispensing means dispenses tickets redeemable for services provided by a gaming establishment.

30. A gaming device according to claim 17 wherein said dispensing means dispenses scratch-off tickets.

31. A gaming device according to claim 17 further comprising a secondary gaming unit comprising means for displaying a randomly selected second indicia from a plurality of possible secondary indicia.

32. A gaming device according to claim 1 wherein said dispensing means dispenses a ticket in response to the occurrence of some game event.

33. A gaming device according to claim 1 wherein said gaming device comprises a bonus event.

34. A gaming device according to claim 1 wherein said dispensing means dispenses a ticket in response to the occurrence of some bonus event.

* * * * *

UNITED STATES PATENT AND TRADEMARK OFFICE

CERTIFICATE OF CORRECTION

PATENT NO. : 6,113,098
DATED : September 5, 2000
INVENTOR(S) : William R. Adams

It is certified that error appears in the above-identified patent and that said Letters Patent is hereby corrected as shown below:

Column 4,
Line 30, please delete “which”.

Signed and Sealed this

Twelfth Day of November, 2002

*Attest:*

*Attesting Officer*

JAMES E. ROGAN
*Director of the United States Patent and Trademark Office*